US007452123B2

(12) United States Patent
Girardin et al.

(10) Patent No.: US 7,452,123 B2
(45) Date of Patent: Nov. 18, 2008

(54) WATCH MOVEMENT COMPRISING SEVERAL BARRELS

(75) Inventors: Johnny Frédéric Girardin, La Chaux-de-Fonds (CH); Stephen Edward Methuen Forsey, Le Locle (CH)

(73) Assignee: Richemont International S.A., Villars-sur-Glane (CH)

( * ) Notice: Subject to any disclaimer, the term of this patent is extended or adjusted under 35 U.S.C. 154(b) by 0 days.

(21) Appl. No.: 11/540,615

(22) Filed: Oct. 2, 2006

(65) Prior Publication Data

US 2007/0091728 A1 Apr. 26, 2007

Related U.S. Application Data

(63) Continuation of application No. PCT/CH05/00052, filed on Feb. 1, 2005.

(30) Foreign Application Priority Data

Apr. 1, 2004 (EP) ..... 04405197

(51) Int. Cl.
*G04B 1/10* (2006.01)
*G04B 1/00* (2006.01)

(52) U.S. Cl. ..... 368/140; 368/203

(58) Field of Classification Search ..... 368/140–147, 368/206, 207, 203
See application file for complete search history.

(56) References Cited

U.S. PATENT DOCUMENTS 3,479,813 A * 11/1969 Kocher ..... 368/142
4,363,553 A * 12/1982 Thomi et al. ..... 368/140
5,278,807 A * 1/1994 Mathys ..... 368/140
7,192,181 B2 * 3/2007 Schmiedchen ..... 368/140
2005/0122844 A1 * 6/2005 Ruchonnet ..... 368/76

FOREIGN PATENT DOCUMENTS

| | | |
|---|---|---|
| CH | 4764 | 3/1892 |
| CH | 6279 | 2/1893 |
| CH | 6286 | 2/1893 |
| CH | 8813 | 7/1894 |
| CH | 13047 | 10/1896 |
| CH | 13141 | 11/1896 |
| CH | 13340 | 11/1896 |
| CH | 26137 | 5/1902 |

(Continued)

OTHER PUBLICATIONS

Diaphane One Brochure, Swatch PR International (14 pages).

(Continued)

*Primary Examiner*—Vit W Miska
(74) *Attorney, Agent, or Firm*—Finnegan, Henderson, Farabow, Garrett & Dunner, LLP

(57) ABSTRACT

A watch movement with a mechanical source of energy is provided. In one implementation, the watch movement comprises a frame intended to support moving parts and defining upper and lower faces. The distance between the upper and lower faces may define a movement thickness. Further, springs may be provided for storing the energy, each being housed in a barrel. At least three barrels may be provided, the first and the second of which are superposed and the third of which is placed laterally to the other two and within their thickness.

16 Claims, 6 Drawing Sheets

FOREIGN PATENT DOCUMENTS

| | | |
|---|---|---|
| CH | 32710 | 2/1905 |
| CH | 34499 | 7/1905 |
| CH | 35466 | 10/1905 |
| CH | 43660 | 4/1908 |
| CH | 46863 | 9/1908 |
| CH | 101654 | 10/1922 |
| CH | 111401 | 11/1924 |
| CH | 114141 | 5/1925 |
| CH | 156504 | 9/1930 |
| CH | 209 682 | 4/1940 |
| CH | 431389 | 8/1967 |
| CH | 529375 | 11/1972 |
| CH | 532806 | 2/1973 |
| CH | 610 465 | 4/1979 |
| EP | 1 115 040 A1 | 7/2001 |
| FR | 1 195 976 A | 11/1959 |
| WO | WO 03/001304 A2 | 1/2003 |

OTHER PUBLICATIONS

PCT Written Opinion of the International Searching Authority, for PCT/CH2005/000052 (5 pages).

* cited by examiner

WATCH MOVEMENT COMPRISING SEVERAL BARRELS

This application is a continuation application of prior International Application No. PCT/CH2005/000052, filed on Feb. 1, 2005, which claims priority to European (EP) Patent Application No. 04405197.7, filed Apr. 1, 2004.

TECHNICAL FIELD

The present invention relates to watch movements having a source of mechanical energy. More particularly, the invention relates to watch movements comprising a frame intended to support moving parts and provided with an upper face and with a lower face, the distance between the faces defining the thickness of the movement. The energy may be stored in the movement in springs each housed in a barrel.

BACKGROUND INFORMATION

A watch movement provided with two springs and with two barrels has been described in document CH 610 465. Two embodiments are envisaged. In the first, the barrels are coaxial while in the second they are placed side-by-side.

A coaxial arrangement of two barrels makes it possible to produce a movement whose area remains small, but which has a relatively large thickness. In contrast, the thickness may be small when the barrels are placed side by side, but they occupy a large area of the movement, corresponding to a sector of about 180°.

To produce watches with a power reserve as large as possible, document EP 1 115 040 proposes to provide a watch with four barrels, placed coaxially in pairs. Such a solution makes it possible not only to store a large amount of potential energy, thereby guaranteeing operation for more than one week, but also to restore it with a speed and a torque that are compatible with a customary going train.

In this construction, the two pairs of coaxial barrels occupy practically the entire thickness of the movement and a sector of around 180°. Under such conditions, the power reserve is admittedly Large, but it is difficult to house mechanisms providing complementary functions. Thus, a power reserve indicator mechanism is placed between the barrels, within their thickness, which means that the coaxial pairs are far apart and must be linked to each other by a gear train. The area of the movement thus occupied is thereby further increased.

Document WO 03/001304 describes a watch movement comprising several barrels, two at a first level and five others placed at a second level lying between the first level and the display means. Admittedly, such a solution provides a particularly large power reserve, but makes it practically impossible to display additional functions.

SUMMARY OF THE INVENTION

An object of an exemplary embodiment of the present invention is to propose a movement for storing a large amount of energy, which uses an available volume in an optimal manner, leaving space for locating additional mechanisms. According to this embodiment, the movement comprises a frame delimited, on the one side, by a bottom plate and, on the other side, by at least one bridge, said bottom plate and bridge being configured to support moving parts and defining upper and lower faces of the movement. The distance between these faces defines the thickness of the movement. In this embodiment, springs are provided for storing the energy, each being housed in a barrel. The movement comprises at least three barrels, a first and a second of which are superposed and define a barrel thickness, the third being placed laterally to the other two and within this barrel thickness, the third barrel not being in superposition with another barrel, and all three barrels being housed within the movement thickness.

In this way, the two superposed barrels may occupy a sector of about 90° over a large portion of the thickness of the movement, while the third barrel may occupy only a portion of the thickness in its sector, thereby making it easier to integrate one or more additional mechanisms.

The two superposed barrels may have a same diameter or different diameters, or they may be slightly offset one with respect to the other. However, it may be advantageous for them to be coaxial.

To guarantee correct kinematic linkage conditions, it may be advantageous:

- for the barrels to each comprise a drum provided with a toothing, and an arbor housed in the drum, the spring being connected to the drum via one of its ends and to the arbor via the other, the arbors of the two coaxial barrels being rigidly connected to each other so as to rotate as one;
- for the arbors to be advantageously connected to each other by the engagement of a male member of one of the arbors in a female member of the other arbor;
- for the third barrel to further include a wheel provided with a toothing and mounted so as to rotate as one on its arbor; and
- for the drum of the first barrel to have a steel ring in which its toothing is cut and for the movement to comprise a train for winding the springs, said train meshing with the toothing of the first barrel.

Thanks to the arrangement defined above, it may be possible to provide the movement with a mechanism, at least some of the constituent components of which may lie in the thickness of the superposed barrels and may be placed between the third barrel and one of the faces of the movement. Consequently, this mechanism does not modify the external dimensions of the movement. For example, this mechanism may provide an indication of a power reserve, winding and time-setting or a chronograph function.

Advantageously, a winding and time-setting mechanism, which may comprise a time-setting stem extending radially outward and able to move rotationally and translationally along an axis parallel to the faces of the movement, may lie at least partly in the space between the third barrel and one of the faces of the movement. The stem may advantageously be oriented in such a way that its axis is approximately a bisector of an angle defined by two straight lines connecting pivot axes of the barrels to a center of the movement.

In accordance with one embodiment, a power reserve indication mechanism may advantageously include a differential gear comprising an output connected to power reserve indication organs or members and two inputs connected by gear trains, respectively, to wheels for tensioning the springs on the one hand, and for driving a going train on the other hand. To simplify the structure of the movement, the third barrel may include an arbor drilled axially right through. At least one of the wheels of these gear trains may include a rod engaged in the drillhole of the arbor in order for wheels of these gear trains placed near the lower and upper faces to possibly be kinematically linked.

BRIEF DESCRIPTION OF THE DRAWINGS

Other features, advantages, and embodiments of the invention will emerge from the following description, which refers to the appended drawings in which.

DETAILED DESCRIPTION

Figure 1:
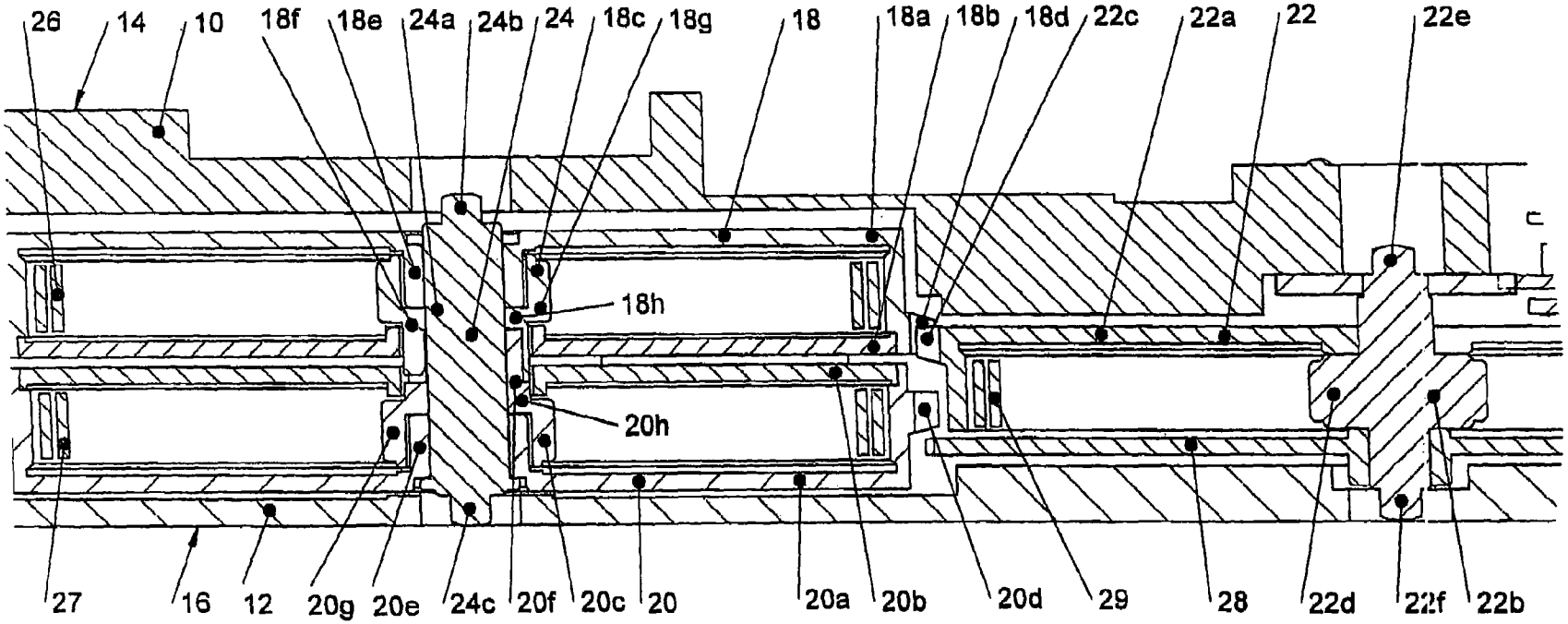
FIG. 1 is a view of a movement, according to one exemplary embodiment of the invention, in cross section taken on a plane passing through the axes of the barrels.

The movement shown in the drawings comprises a frame, visible more particularly in FIG. 1, comprising a bottom plate 10 and bridges, notably a barrel bridge 12. The outer face of the bottom plate 10 defines the upper face 14 of the movement, which may be covered by a dial, while the outer face of the bridges defines the lower face 16 of the movement, which is generally on the bottom side of the case.

The bridges may be positioned on the bottom plate 10 in the conventional way by means of feet, and fixed by means of screws—not shown in the drawings to avoid overloading them.

Three barrels with the references 18, 20 and 22 respectively are installed between the bottom plate 10 and the bridge 12. The barrels 18 and 20 are coaxial. They are mounted so as to pivot between the bottom plate 10 and the bridge 12 on a rod 24 which is cylindrical in its central part 24*a* and has, at its ends, two pivots 24*b* and 24*c* engaged in holes in the bottom plate 10 and in the bridge 12, respectively.

The barrels 18 and 20 each comprise a drum identified by the letter a, a cover b and an arbor c. The drums a are provided on their cylindrical outer wall with a toothing d whose function will be explained later. They have in their central part a tubular portion e in which the rod 24 is engaged.

Advantageously, the toothing 20*d* may be formed in a steel ring mounted on the drum 20*a*.

The arbors c are drilled-out and possess two tubular portions f and g connected by an annular portion h. The smaller diameter tubular portions f are mounted on and pivot about the rod 24 in line with each other. At their free end are structures of complementary shape, which interlock so that they rotate as one. The larger diameter tubular portions g are engaged on the tubular portions e of the drum and are provided with a hook, thus forming a core.

Springs 26 and 27 are housed in the barrels 18 and 20, respectively, and fixed at one end to the inside wall of the drum a and at the other to the hook of the tubular portion g which forms the core.

The covers b snap onto the drums a in the conventional manner.

The barrel 22 comprises a drum 22*a* and an arbor 22*b*. The drum 22*a* is provided with a toothing 22*c* around its periphery, meshing with the toothing 18*d* of the barrel 18. The arbor 22*b* is provided in its central part with a portion having a hook and forming a core 22*d*, and at its ends with two pivots 22*e* and 22*f* engaged in bearings in the bottom plate 10 and in the bridge 12, respectively.

The arbor 22*b* carries, fixed rigidly between the core 22*d* and the pivot 22*f*, a wheel 28 that covers the open side of the drum 22*a*. A spring 29 is installed in the drum 22*a* and fixed to the latter by one of its ends and to the core 22*d* by the other.

As can be seen in FIG. 1, the coaxial barrels 18 and 20 may occupy a large part of the thickness of the movement. The barrel 22, being positioned by the side of the barrels 18 and 20, and within their thickness, leaves a space between itself and the faces 14 and 16 that may be used to house all or part of a mechanism, as will be explained later.

The springs installed in the barrels 18, 20 and 22 may be wound by a winding mechanism which will be described later, using a wheel that meshes with the toothing 20*d* of the barrel 20. In this ways the drum 20*a* is rotated. The spring 27 which it contains, and one end of which is hooked to the wall of the drum 20*a*, is wound by the rotation of the drum. The arbor 20*c*, to which the other end of the spring 27 is fixed, is subjected to a torque, which is transmitted to the arbor 18*c*.

Since the latter is connected to one end of the spring 26 housed in the barrel 18, this spring 26 is also wound and applies a torque to the drum 18*a* through its other end. The toothing 18*d* then rotates the toothing 22*c* of the barrel 22, which thus winds the spring 29 that it contains, thereby applying a torque to the arbor 22*b*, which is transmitted to the going train by the wheel 28, as will be explained below.

Figure 2:
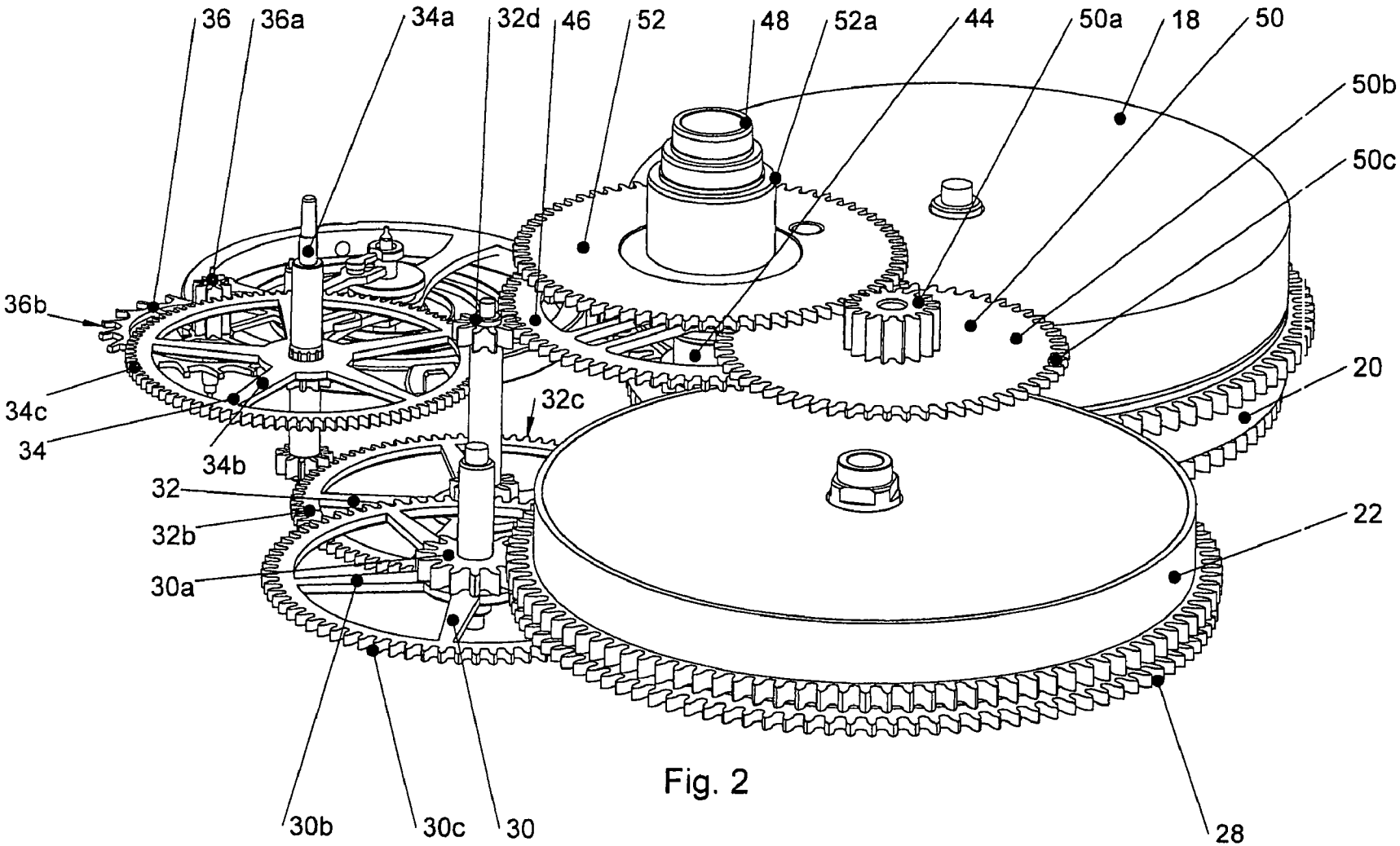
FIG. 2 shows, in a perspective view from below, the trains, the escapement and the balance of the exemplary movement of FIG. 1.

The going train is clearly visible in FIG. 2. Its various wheels pivot, of course, in the frame, which has not been shown in order to simplify the reading of the drawing. This train may comprise a center wheel 30, a third wheel 32, a fourth wheel 34 and an escape wheel 36. Each of these wheels comprises a pinion identified by the letter "a" and a disk identified by the letter "b," which is provided with a toothing identified by the letter "c."

The barrel 22 rotates the center wheel 30 by the meshing of the wheel 28 with the pinion 30*a*. The going train is designed so that the center wheel makes one revolution per hour. Its toothing 30*c* meshes with the pinion 32*a* of the third wheel 32, which rotates as one with the disk 32*b* and the toothing 32*c* which meshes with the pinion 34*a* of the fourth wheel 34. The latter, which makes one revolution in one minute, meshes through its toothing 34*c* with the pinion 36*a* of the escape wheel 36, and the last-mentioned drives, in the conventional manner, the pallet lever and the balance, which have not been given reference symbols.

A tube 44 may be mounted rigidly in the center of the bottom plate and extends beyond the face 14. Its function is to enable the wheels carrying the central hands to pivot.

More precisely, to display the minutes, the going train may also have a central wheel 46 meshing with a second pinion 32*d* of the third wheel 32 and supporting a cannon pinion 48 mounted with friction and engaged on the tube 44. The cannon pinion 48 is designed to be able to carry a minute hand.

The movement may also includes a motion work train, the first part of which is the cannon pinion 48. A minute wheel 50, comprising a pinion 50*a* and a disk 50*b* with a toothing 50*c*, pivots on the bottom plate 10 and its toothing 50*c* meshes with the cannon pinion 48. Its pinion 50*a* drives an hour wheel 52 engaged by its pipe 52*a* on the cannon pinion 48, this pipe being designed to hold an hour hand.

Figure 3:
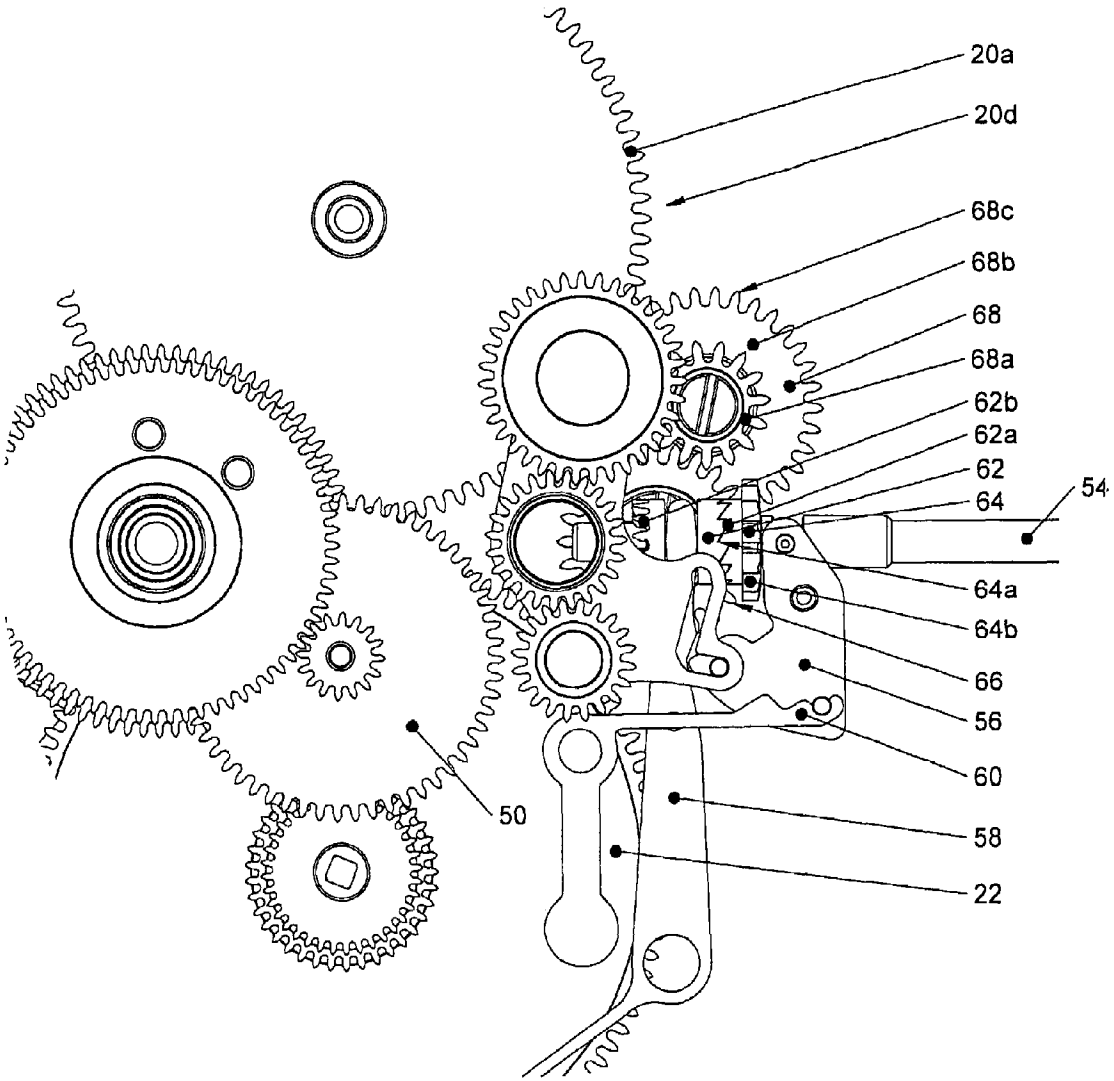
FIG. 3 is a plan view of one exemplary embodiment of the winding and time-setting mechanism.

An exemplary embodiment of a winding and time-setting mechanism is shown in FIG. 3. In FIG. 3, the frame has again been omitted in order to make the components of this mechanism more clearly visible.

This mechanism may comprise, in the conventional manner, a winding and time-setting stem 54, a setting lever 56, a clutch lever 58, and a jumper bridge 60.

The stem 54 is mounted so as to pivot in the bottom plate 10 about an axis parallel to the faces 14 and 16 of the movement and extending outward from the center of the movement. This axis may approximately be the bisector of an angle defined by two straight lines connecting the pivot axes of the barrels 18 and 20 on the one hand, and of the barrel 22 on the other, to the center of the movement.

Mounted on the stem 54 are a clutch wheel 62 and a winding pinion 64 engaging or not engaging with each other depending on the radial position of the stem and its direction of rotation, via a Breguet toothing identified by the letter a. The clutch wheel 62 also has a contrate toothing 62*b* and the winding pinion 64 has a radial toothing 64*b*.

A crown wheel 66 is placed below the clutch wheel 62, mounted on the bridge of the barrel 12 and engaged with the winding pinion 64 via its radial toothing 64*b*, and also with an intermediate wheel 68 comprising a pinion 68*a* that meshes with the crown wheel 66 and a disk 68*b* provided with a toothing 68*c*, which drives the drum 20*a* via its toothing 20*d*.

Thus, and as generally occurs in mechanical watches, the barrel springs 26, 27 and 29 may be wound by rotating the stem 54 when it is in the pushed-in position. This rotation drives the clutch wheel 62, engaged with the winding pinion 64, via their toothings 62*a* and 64*a* (e.g., Breguet toothings), which rotates the crown wheel 66 and the intermediate wheel 68 that meshes with the toothing 20*d* of the drum 20.

Figure 4:
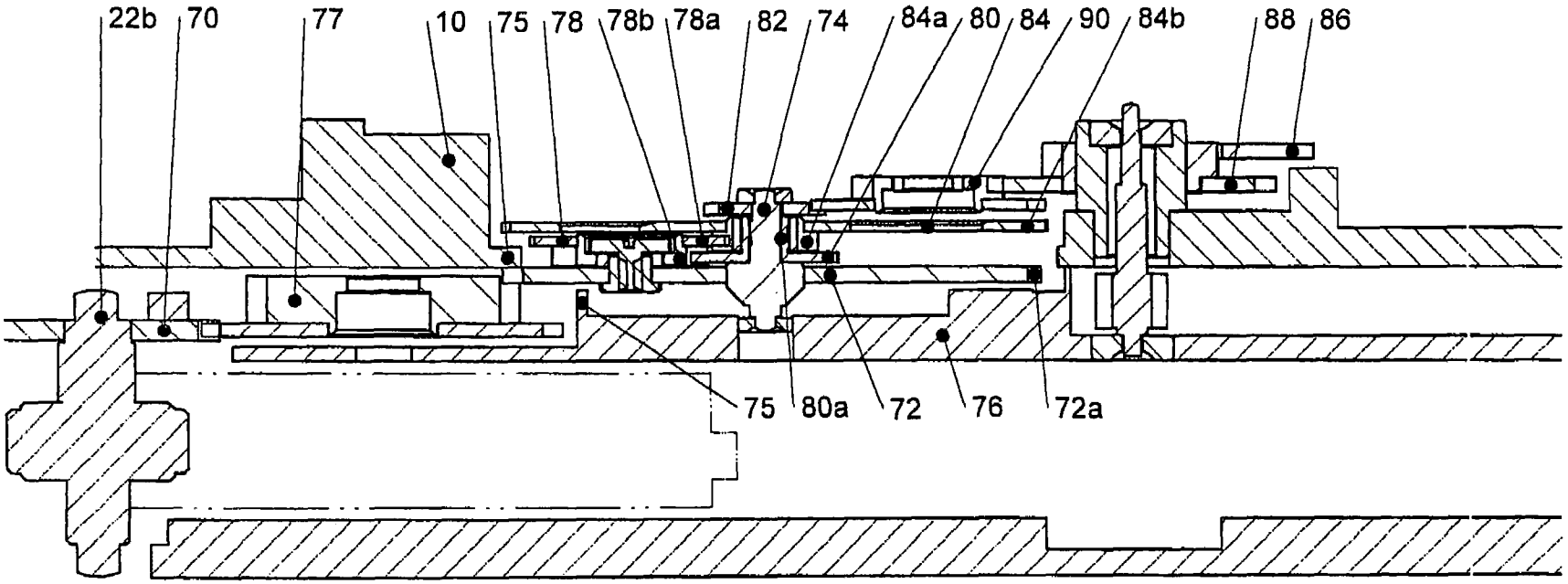
FIG. 4 illustrates, in cross section, an exemplary embodiment of a power reserve mechanism of the movement.

FIG. 4 shows an exemplary embodiment of a power reserve indicator mechanism comprising a differential gear. It is controlled on the one hand by means of a wheel 70 mounted so as to rotate as one on the arbor 22*b* of the barrel 22, which rotates synchronously with the going train, and, on the other hand, by means of a linkage train engaged with the crown wheel 66, this linkage train being not shown in the drawing otherwise it would mask the other constituents.

More precisely, the differential gear comprises a planet wheel 72 mounted so as to rotate freely on an arbor 74 and positioned axially by stops 75 defined by the bottom plate 10 and an intermediate bridge 76 carried by the bottom plate 10. The planet wheel is provided with a toothing 72*a* that meshes, via a wheel 77, with the wheel 70 carried by the arbor 22*b* of the barrel 22. It thus forms the winding entry of the power reserve indicator.

The planet wheel 72 carries a satellite wheel 78 comprising a wheel 78*a* and a pinion 78*b*. The arbor 74 pivots in bearings that the bottom plate 10 and the bridge 76 have, It carries a lantern pinion 80, which meshes with the pinion 78*b* and also an output wheel 82 that rotate as one, the function of which will be explained later.

The lantern pinion 80 is provided with a pipe 80*a* frictionally mounted on the arbor 74 in order to form the lanterning, and on which an unwinding entry wheel 84, which comprises a pinion 84*a* and wheel 84*b*, pivots. The pinion 84*a* meshes with the wheel 78*a* of the satellite wheel 78, while the wheel 84*b* is kinematically linked to the crown wheel 66 via the linkage train.

Thus, when the user winds his watch, the crown wheel 66 drives the wheel 84 via the linkage train. Its pinion 84*a* engages with the wheel 78*a* of the satellite wheel 78. Since the planet wheel 72 is engaged with the wheel 70 and, thereby, with the arbor 22*b* of the barrel 22, it rotates only very slowly. The satellite wheel 78, therefore, remains virtually immobile about the axis of the planet wheel. However, it rotates about its own axis and its pinion 78*b* drives the wheel 80. The latter makes the arbor 74 rotate via its lanterned pipe 80*a* and the output wheel 82.

The rotation of the barrel 22, which drives the going train, furthermore rotates the wheel 70 and the wheel 77. The latter, engaged with the planet wheel 72, rotates it. Since the crown wheel 66 is immobile, the wheel 84 is likewise immobile. This means that the wheel 78*a* of the satellite wheel rolls over the pinion 84*a*, the pinion 78*b* rotating the lantern pinion 80 and, with it, the arbor 74 that rotates the output wheel 82, but in the opposite direction to that caused by the rotation of the crown wheel 66.

The power reserve may be displayed by means of a rack 86 mounted so as to slide in the bottom plate 10 and kinematically linked to the wheel 82 via two wheels 88 and 90. The rack may be provided with an index visible on the dial.

In the exemplary embodiment of the movement described above, the arrangement of the barrels 18, 20 and 22 makes it possible to house a considerable portion of the components of the time-setting and power-reserve mechanisms in the thickness of the barrel 18 and above the barrel 22, which represents a particularly advantageous distribution of the components of the movement.

Figure 5:
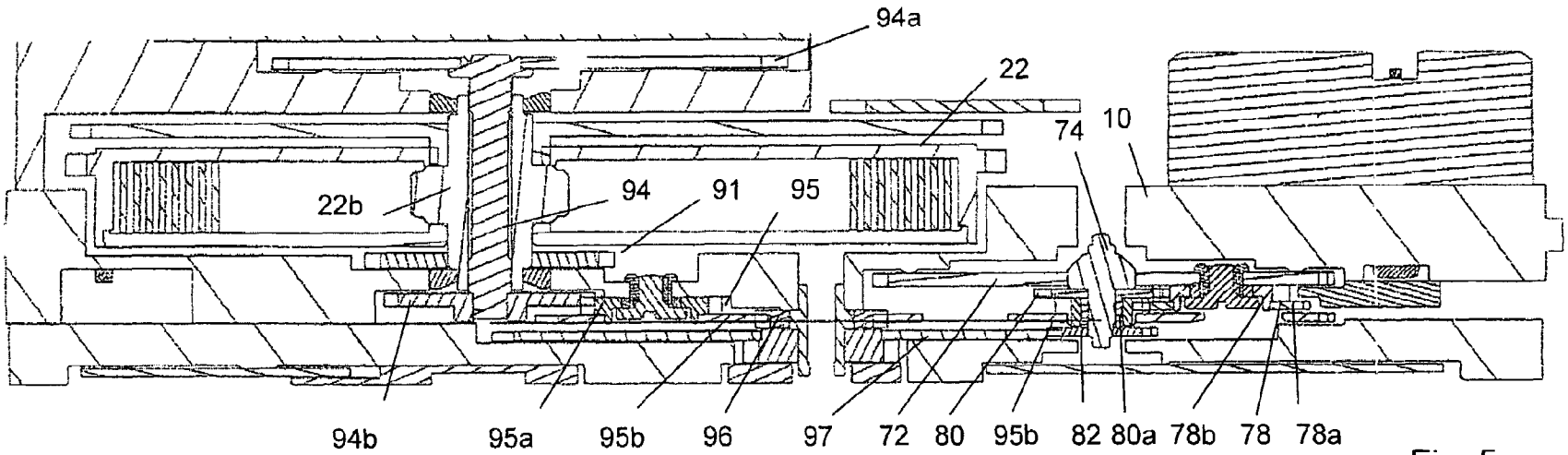
FIG. 5 and FIG. 6 are cross sections through a movement comprising a power reserve mechanism according to a further exemplary embodiment.
Figure 6:
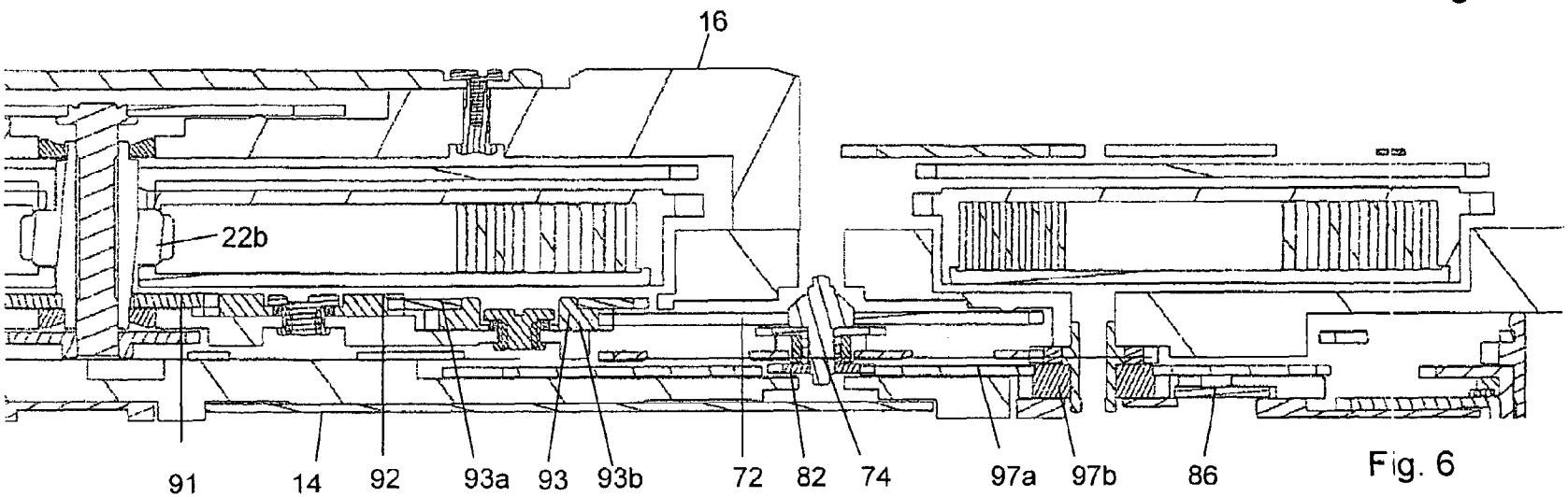

The movement according to the further exemplary embodiment shown in FIG. 5 and FIG. 6 is similar to that described above. Its power-reserve indicator mechanism differs therefrom essentially by the structure of the train for driving the indicator.

FIG. 5 and FIG. 6 again show the barrel 22, its arbor 22*b* and the rack 86. The latter, mounted so as to move translationally along the bottom plate 10, carries an index indicating, with reference to a scale on the dial of the watch, the tensioning state of the springs.

They also again show the differential gear with its planet wheel 72, mounted on the arbor 74, and its satellite wheel 78 formed from the wheel 78*a* and the pinion 78*b*. The arbor 74 carries the wheel 80 provided with the pipe 80*a* frictionally mounted on the arbor 74, and also the wheel 82 which rotates as one with the arbor 74.

As may be seen in FIG. 6, the planet wheel 72 is linked to the arbor 22*b* of the barrel 22 by a gear train comprising a first gear 91 that rotates as one with the arbor 22*b*, a second gear 92 and a wheel 93 that includes a wheel 93*a*, engaged with the gear 92, and a pinion 93*b* meshing with the planet wheel 72. This gear train drives the power reserve indicator during spring unwinding.

To control the movement of the power reserve indicator during spring winding, it is necessary to pass from the lower face 16, near which the toothing 20*d* of the barrel 20 lies, which ensures spring winding, to the upper face 14 near which the differential gear lies.

As may be seen in FIG. 5, the barrel arbor 22*b* may be drilled-out axially and may serve as housing for a rod 94 that passes right through said arbor. This rod carries, so that they rotate as one, a wheel 94*a* kinematically linked to the toothing 20*d* of the barrel 20 and a gear 94*b* that drives the gear train that controls the displacement of the power reserve indicator during spring winding. This gear train comprises a wheel 95, formed from a pinion 95*a* engaged with the gear 94*b* and from a wheel 95*b* and a gear 96 connecting the wheel 95*b* to the pinion 80*a*.

Finally, the wheel 82 provides (see FIG. 6) the linkage between the differential gear and the rack 86 via a wheel 97, comprising a toothed wheel 97*a* engaged with the wheel 92 and a pinion 97*b* driving the rack 86.

The operation of this exemplary movement is the same in its principle, the differential gear making it possible to drive in one direction the display during spring winding and in the other direction during unwinding. It is quite clear that the various wheels linking, on the one hand, the toothing 20*d* via which the winding takes place and, on the other hand, the arbor 22*b* to the differential gear may advantageously be designed in such a way that the displacement of the rack is the same for the same winding or unwinding angle. Such a design is within the competence of a person skilled in the art.

Figure 7:
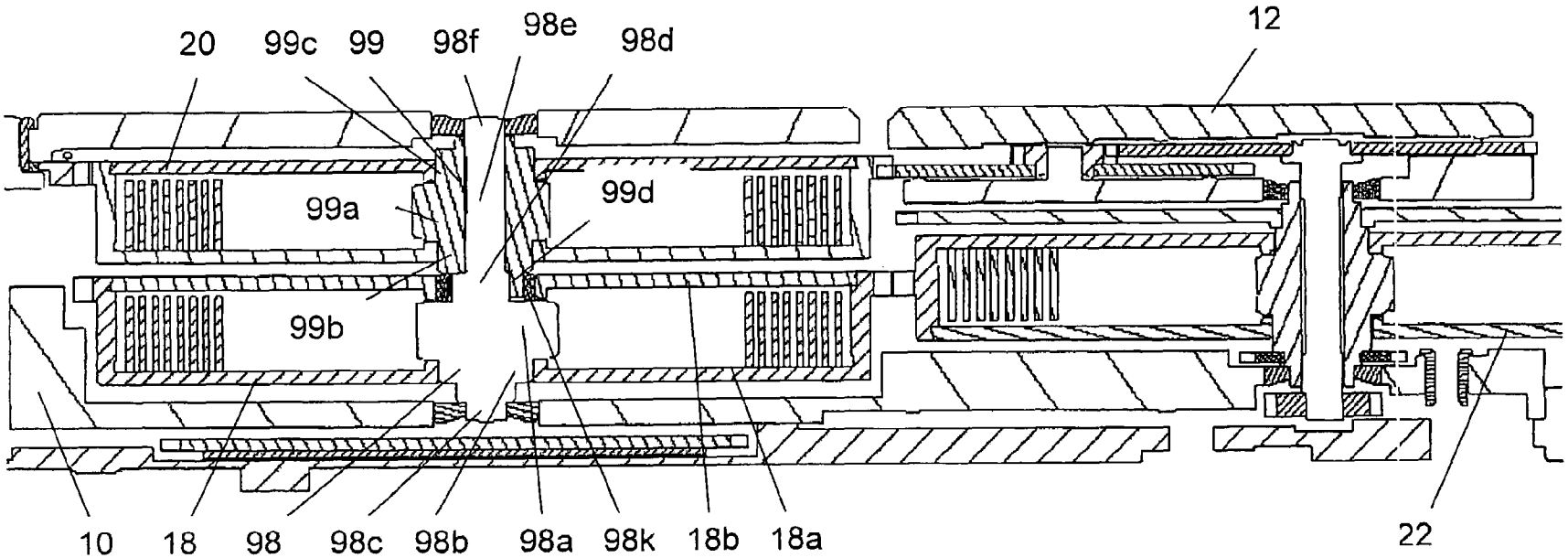
FIG. 7 is a cross section view of an alternative exemplary embodiment of the barrel arrangement in the movement.

FIG. 7 shows an alternate exemplary embodiment of the movement in which the structure of the barrels and the way in which they are mounted in their frame are different from those described above. However, the same components therein bear the same references. The essential difference relates to the arbors of the coaxial barrels 18 and 20.

In this variant, the barrel 18 is provided with an arbor 98 comprising a central part 98*a* housed in the space lying between the drum 18*a* and the cover 18*b* and forming a core, a cylindrical portion 98*b* adjacent the central part 98*a* and engaged in a hole at the bottom of the drum 18*a,* in order to form a pivot. The portion 98*b* is extended by a pivot 98*c* that pivots in the bottom plate 10. A linking portion 98*d* and a cylindrical portion 98*e* extend from the central portion 98*a* toward the bridge 12. The linking portion is of cylindrical shape provided with two flats, the function of which will be explained below. The cylindrical portion 98*e* is provided at its end with a pivot 98*f* engaged in a bearing that this bridge has.

A ring 98*k,* advantageously made of steel, is slipped onto the arbor 98, surrounding the linking portion 98*d*. The outside diameter of the ring 98*k* is slightly smaller than that of the hole in the cover 18*b,* in such a way that it can pivot in the cover 18*b* of the barrel 18. Because of the flats with which this linking portion 98*d* is provided, there exists, between said linking portion and the ring 98*k,* spaces intended to take the place of housings, as will be explained below.

The barrel 20 includes an arbor 99 that has a central part 99*a* forming a core. It is drilled right through and engaged on the cylindrical portion 98*e*. The arbor 99 is provided right through its central part 99*a* with two cylindrical portions 99*b* and 99*c,* which are engaged in the drum 20*a* and in the cover 20*b,* respectively, and form pivots. The end of the portion 99*b* is extended by two fingers 99*d* engaged in the housings that the ring 98*k* and the linking portion 98*d* form between them, thus making the arbors 98 and 99 rotate as one.

In this variant, the barrel drums and covers are advantageously made of a beryllium-copper alloy.

This second variant makes it possible to reduce the number of constituent components, since the arbor 98 provides both functions of the rod 24 and of the arbor 20*c* of the first variant.

It goes without saying that the movement described may be subject to many other variants without thereby departing from the scope of the invention. This is particularly the case with regard to the way in which the barrels are linked together. It is also possible, for certain particular applications, to place the superposed barrels so that they are slightly offset one with respect to another.

It is also conceivable to place one or more barrels in addition to the three described above. Nothing would prevent a fourth barrel from being incorporated into the movement, independently or integrated into the kinematic chain of the going train.

Thus, thanks to the structure of movements consistent with embodiments of the invention, it may be equipped with many other mechanisms, whether or not placed in the space thus made available. For example, mention may be made of a perpetual calendar, a countdown timer, a repeater, etc.

The invention claimed is:

1. A watch movement provided with a mechanical source of energy, in which said energy is stored in springs each housed in a barrel, said movement comprising:

a frame delimited, on the one side, by a bottom plate and, on the other side, by at least one bridge, said bottom plate and bridge being configured to support moving parts of said movement and defining upper and lower faces of said movement, said upper and lower faces being distant from each other by a distance defining a movement thickness;

at least three barrels, all of which are housed within said movement thickness, a first barrel and a second barrel being superposed, and a third barrel being placed laterally to said first and second barrels and at least partly inside a thickness defined by said first barrel and a thickness defined by said second barrel, said third barrel not being in superposition with any other barrel; and a power reserve indicator having constituent components at least some of which lie within said thickness of said first and second barrels and are placed between said third barrel and one of said upper and lower faces.

2. The movement according to claim 1, said first and second barrels being coaxial.

3. The movement according to claim 2, said first, second and third barrels each comprising a drum provided with a toothing and an arbor housed in said drum, each of said springs having two ends, one of which is connected to said drum and the other to said arbor, and said arbors of said first and second barrels being rigidly connected to each other so as to rotate together.

4. The movement according to claim 3, said arbors of said first and second barrels being rigidly connected to each other so as to rotate together by engagement of a male member of one of said arbors in a female member of the other of said arbors.

5. The movement according to claim 3, said third barrel further including a wheel provided with a toothing and mounted so as to rotate together with said arbor of said third wheel.

6. The movement according to claim 3, said drum of said first barrel having a steel ring in which said toothing is cut, said movement comprising a train for winding said springs, and said train meshing with said toothing of said first barrel.

7. The movement according to claim 1, each of said barrels comprising an arbor defining a pivot axis, said movement further having a center, wherein said mechanism provides winding and time-setting functions and comprises a time-setting stem that extends radially outward, and that is able to move rotationally and translationally along an axis parallel to said upper and lower faces, and said axis being approximately a bisector of an angle defined by two straight lines connecting said pivot axes of said barrels to said center of said movement.

8. The movement according to claim 1, further including a differential gear comprising an output connected to power reserve indication organs and a first and a second inputs connected, respectively, by gear trains to wheels, for winding said springs on the one hand, and for driving a going train on the other hand.

9. The movement according to claim 8, said arbor of said third barrel being drilled axially right through at least one of said wheels including a rod engaged in said arbor, in order for allowing wheels placed near said lower and upper faces to be kinematically linked.

10. A watch movement enclosed between a bottom plate and at least one upper bridge, said watch movement comprising:

a mechanical source of energy in the form of springs housed within at least three barrels including a first barrel, a second barrel, and a third barrel, wherein said first and second barrels are coupled together and directly located one above the other, and wherein said third barrel is located laterally with respect to said first and second barrels and at least partly inside a thickness defined by said first barrel and a thickness defined by said second barrel, said third barrel is coupled to at least one of said first and second barrels, and said third barrel is not superimposed with any other barrel within said movement; and a mechanism located, at least in part, laterally with respect to said first and second barrels and either above or below said third barrel, said mechanism including a non-static component and providing a function for said watch movement other than acting as a mechanical source of energy.

11. The watch movement according to claim 10, wherein said first and second barrels are coaxial.

12. The movement according to claim 10, wherein said mechanism is a power reserve indicator.

13. A watch movement comprising:

a single frame delimited by a bottom plate on one side and at least one bridge on the other side, said bottom plate and at least one bridge configured to support moving parts of said movement and to define an upper face and a lower face of said movement, said upper face and said lower face being separated by a distance defining a movement thickness;

at least three barrels, housed within said movement thickness and containing springs for storing energy, the at least three barrels comprising a first barrel and a second barrel that are superposed with respect to one another, and a third barrel placed laterally to said first and second barrels and not in superposition with said first barrel or the second barrel; and a mechanism located, at least in part, laterally with respect to said first and second barrels and within a space defined either above or below said third barrel and within said movement thickness, said mechanism including a non-static component and providing a function for said watch movement other than acting as a mechanical source of energy.

14. The watch movement according to claim 13, wherein said mechanism is a power reserve indicator.

15. The watch movement according to claim 13, wherein said first and second barrels define a barrel thickness, and said third barrel is located within said barrel thickness.

16. A watch movement comprising:

a single frame delimited by a bottom plate on one side and at least one bridge on the other side, said bottom plate and at least one bridge configured to support moving parts of said movement and to define an upper face and a lower face of said movement, said upper face and said lower face being separated by a distance defining a movement thickness;

at least three barrels, housed within said movement thickness and containing springs for storing energy, the at least three barrels comprising a first barrel and a second barrel that are superposed with respect to one another, and a third barrel placed laterally to said first and second barrels and not in superposition with said first barrel or the second barrel; and a power reserve indicator located, at least in part, laterally with respect to said first and second barrels and within a space defined either above or below said third barrel and within said movement thickness.

* * * * *